US006461010B1

(12) United States Patent
Knight et al.

(10) Patent No.: US 6,461,010 B1
(45) Date of Patent: Oct. 8, 2002

(54) OVEN LIGHT ASSEMBLY HAVING HOUSING AND EASILY REMOVABLE LENS

(75) Inventors: Jimmy Nelson Knight; Syndra Lou Scherffius; William Daniel Croce, all of Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/301,142

(22) Filed: Apr. 28, 1999

(51) Int. Cl.[7] ..... F21V 5/00

(52) U.S. Cl. ..... 362/92; 362/374; 362/375; 362/455

(58) Field of Search ..... 362/92, 94, 368, 362/370, 374, 375, 455

(56) References Cited

U.S. PATENT DOCUMENTS 1,611,562 A * 12/1926 Robson ..... 362/92
4,326,243 A * 4/1982 Pistor et al. ..... 362/368
5,738,437 A * 4/1998 Ilagan ..... 362/363

* cited by examiner

*Primary Examiner*—Alan Cariaso
*Assistant Examiner*—Ronald E. DelGizzi
(74) *Attorney, Agent, or Firm*—H. Neil Houser; George L. Rideout, Jr.; Armstrong Teasdale LLP

(57) ABSTRACT

An oven light assembly includes a lens, a housing, a lamp base and a light bulb. The lens and housing protect the light bulb from the oven environment. The housing includes a rim having cantilever beams and louvers that engage flanged lips on an outer edge of the lens. Cantilever beams apply an upward force to maintain the flanged lips in the louvers. The housing maintains the lens properly positioned and allows removal of the lens without the use of tools.

20 Claims, 3 Drawing Sheets

OVEN LIGHT ASSEMBLY HAVING HOUSING AND EASILY REMOVABLE LENS

BACKGROUND OF THE INVENTION

This invention relates generally to light assemblies and, more particularly, to light assemblies for ovens.

Ovens typically include lights to illuminate a cooking area within the oven, i.e., an oven chamber. A known oven light includes a light bulb embedded in an interior wall of the oven chamber. To protect the bulb from breakage due to incidental contact and corrosion due to cooking residue, the light bulb is positioned in a housing and covered by a lens. If the lens is not properly positioned with respect to the housing while the oven is used, the protection of the light bulb will be compromised, and the life of the light bulb may be shortened. Due to the light bulb location inside the oven, changing the oven light bulb can be difficult, especially if tools are needed to remove the lens cover.

Accordingly, it would be desirable to provide an oven light assembly that allows removal of the lens and replacement of the light bulb without tools. Further, it would be desirable to ensure that the lens remains properly positioned with respect to the housing while the oven is used so that the light bulb is protected.

BRIEF SUMMARY OF THE INVENTION

In an exemplary embodiment of the invention, an oven light assembly includes a lamp base, a light bulb, a housing, and a lens that can be removed without the use of tools. The light bulb is electrically connected to the lamp base, and the housing and the lens surround the light bulb and protect the bulb from exposure to the oven environment. The housing retains the lens in a proper position, and the lens is easily removed from the housing without using tools.

The lamp base includes a light bulb socket, and the light bulb is electrically connected to the socket. The housing includes a rim having an engagement surface configured to releasably engage the lens to hold the lens in a proper position. The engagement surface includes louvers and cantilever beams that are inclined relative to the engagement surface.

The lens is serrated and includes an outer edge. The lens outer edge includes flanged lips positioned adjacent the inclined ends of the lens cantilever beams so that when the beams deflect, the beams press the lens flanged lips into contact with the housing louvers. The cantilever beams maintain the lens properly positioned by applying a force to the flanged lips of the lens.

The lens is easily removed from the oven light assembly by pushing the lens toward the housing and depressing the cantilever beams to free the flanged lips from the louvers. The lens is then rotated until the flanged lips are no longer in contact with the louvers.

No tools are required to remove the lens from the housing, and the light bulb may be quickly and easily accessed by removing the lens. Further, the lens protects the light bulb from cooking debris.

DETAILED DESCRIPTION OF THE INVENTION

Figure 1:
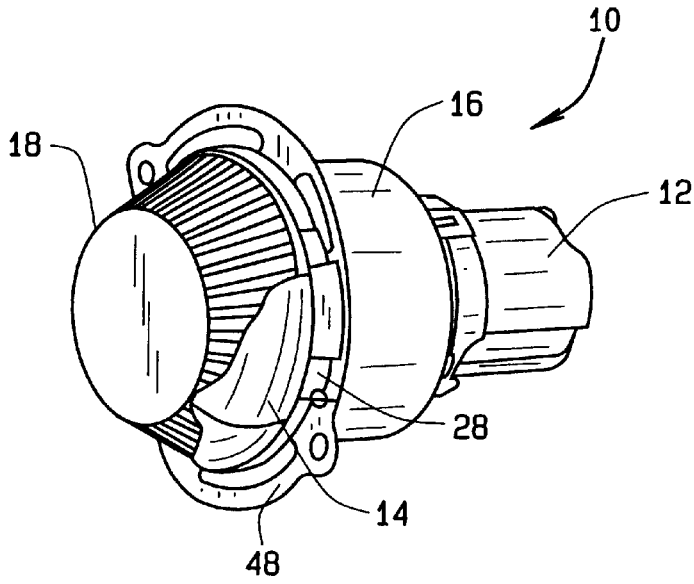
FIG. 1 is a perspective view of an oven light assembly partially broken away.

FIG. 1 is a partially broken away perspective view of an oven light assembly 10 including a lamp base 12, a light bulb 14, a housing 16 and a lens 18. Light assembly 10 is used in an oven (not shown) to illuminate an oven cooking chamber (not shown).

Light bulb 14 is connected to lamp base 12 which is connected to housing 16. Housing 16 is connected to lens 18, and both housing 16 and lens 18 surround light bulb 14 and protect bulb 14 from exposure to the oven environment. Lens 18 may be easily removed by hand so that light bulb 14 may be removed from housing 16 due to the cooperation of flanged lips 28 of lens 18 and an engagement surface 48 of housing 16. Also, lens 18 is maintained in proper position with respect to housing 16 through the interaction of engagement surface 48 and flanged lips 28, as is explained in detail below.

Figure 2:
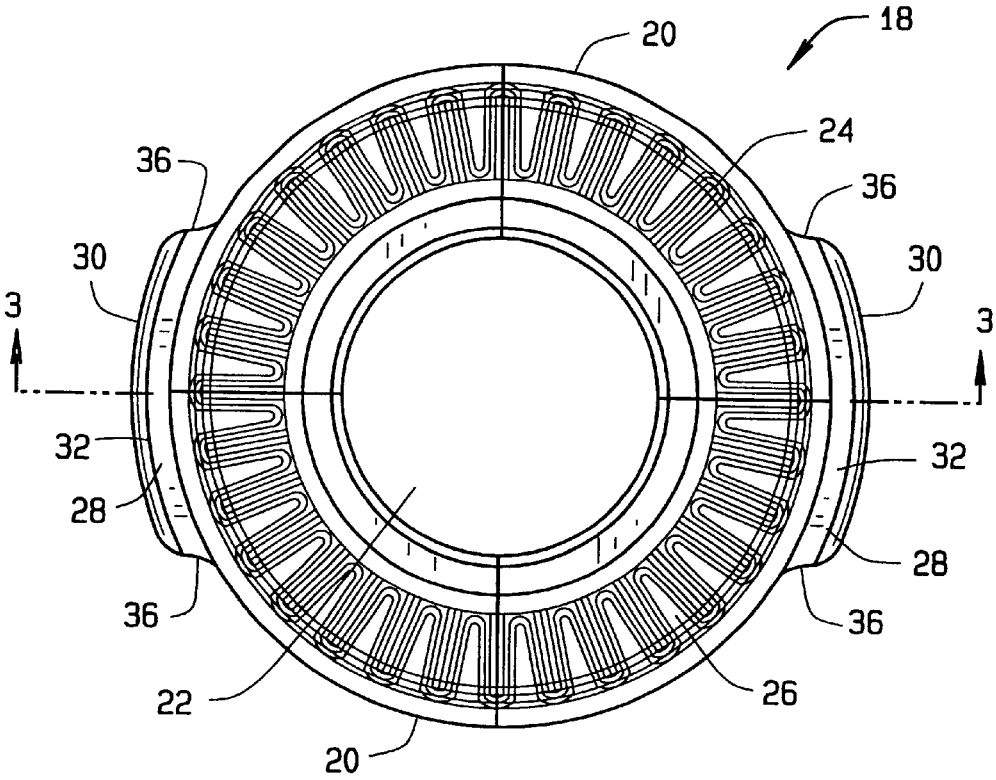
FIG. 2 is a top plan view of the lens shown in FIG. 1.

FIG. 2 is a top plan view of lens 18 shown in FIG. 1. Lens 18 includes a substantially circular outer edge 20, and a substantially circular exterior cover 22. Lens 18 further includes a plurality of exterior serrations 24 extending from cover 22 to outer edge 20 along a side 26. Outer edge 20 includes flanged lips 28 spaced approximately 180° from one another around a perimeter of outer edge 20. Each flanged lip 28 extends radially outwardly from outer edge 20 and includes an arcuate engagement edge 30 substantially concentric to outer edge 20. Each flanged lip 28 also includes a first surface 32, a second surface 34 (not shown in FIG. 2), and a pair of side edges 36.

Lens 18 is fabricated from plastic, glass, or other transparent or translucent material capable of withstanding the heat of the oven while allowing light from light bulb 14 (FIG. 1) to illuminate the cooking chamber. In an alternative embodiment, the outer edge is polygonal and the sides of the lens are unserrated. In addition, the lens includes one, three, or more flanged lips.

Figure 3:
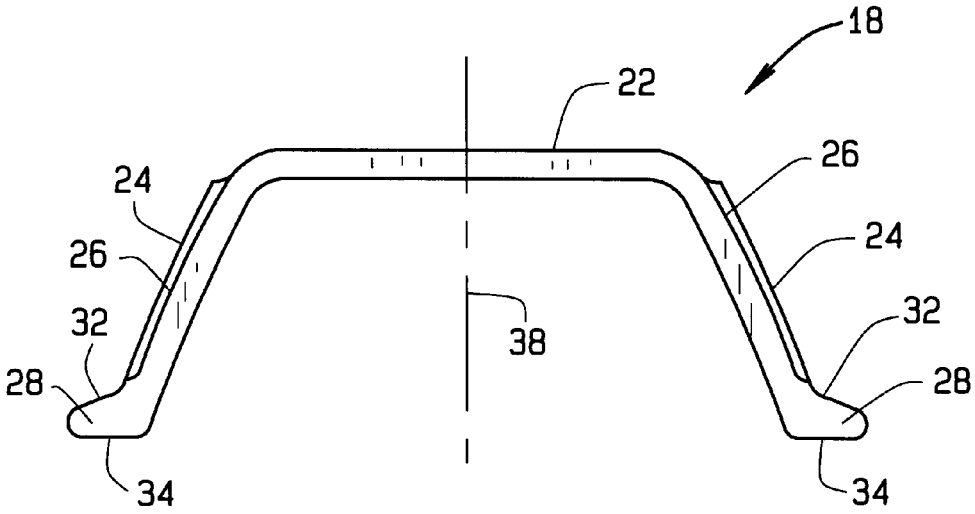
FIG. 3 is a cross-sectional view of the lens shown in FIG. 2 along line 3—3.

FIG. 3 is a cross sectional view of lens 18 which is symmetrical about a center axis 38. Side 26 extends upwardly from flanged lip 28 to cover 22, thereby forming a protective enclosure for a light bulb 14 (shown in FIG. 1). Serrations 24 also extend upwardly from flanged lips 28 toward cover 22. Serrations 24 facilitate gripping lens 18 along side 26. Flanged lips 28 include a first surface 32 and a second surface 34. Second surface 34 is substantially flat, while first surface 32 is inclined relative to second surface 34.

Figure 4:
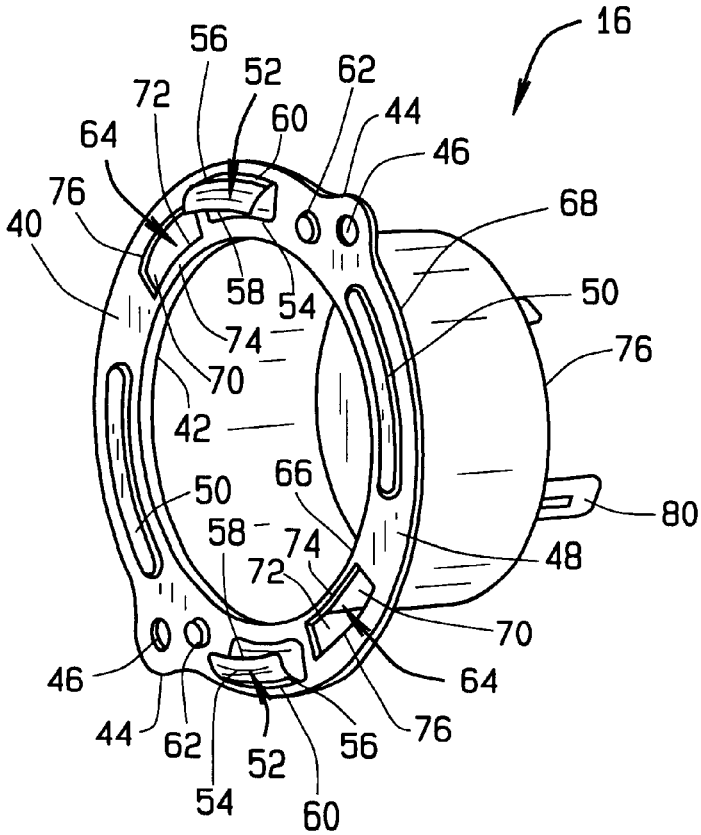
FIG. 4 is a perspective view of the housing shown in FIG. 1.

FIG. 4 is a perspective view of housing 16 including a rim 40 and a first end 42. Housing 16 is substantially cylindrical and rim 40 extends from first end 42. Rim 40 is substantially circular and includes flanges 44 including openings 46 for mounting housing 16 to an interior wall (not shown) of the oven (not shown). Housing 16 is fabricated from drawn sheet metal. In an alternative embodiment, rim 40 is polygonal and is fabricated from materials other than sheet metal.

Rim 40 includes an engagement surface 48 that contacts lens 18 (shown in FIG. 1). Engagement surface 48 includes raised ribs 50, louvers 52, stops 62, and cantilever beams 64. Raised ribs 50 have an arcuate shape, extend from engagement surface 48, and are positioned approximately equidistant from an inner edge 66 and an outer edge 68 of annular rim 40. Raised ribs 50 are substantially symmetrically located and separated from one another by louvers 52, stops 62 and cantilever beams 64.

Louvers 52 project from rim 40 and include a distal end 54, a proximal end 56, an inner edge 58, and an outer edge 60. Outer edge 60 is connected to rim 40. Inner edge 58, proximal end 56, and distal end 54 are separated from rim 40. Louvers 52 are formed by punching, or shearing, a portion of rim 40 on three sides and bending the portion upwardly and inwardly from engagement surface 48. Louvers 52 are separated approximately 180° from one another around the rim 40, and are separated from raised ribs 50. Stop 62 is substantially semicircular and projects from engagement surface 48 adjacent each louver 52. Stops 62 are pre-formed into rim 40, punched from rim 40, or otherwise fabricated according to known methods.

Cantilever beams 64 include a proximal end 70, a distal end 72, an inner edge 74, and an outer edge 76. Rim 40 is punched, or sheared, on three sides and bent to form cantilever beam 64 so that distal end 72, inner edge 74, and outer edge 76 are separated from engagement surface 48 and proximal end 70 is attached to engagement surface 48. Thus, cantilever beams 64 are generally raised relative to engagement surface 48. Cantilever beams 64 are positioned approximately 180° from one another on rim 40 and are separated from louvers 52 and raised ribs 50. Cantilever beams 64 extend arcuately and are approximately equidistant from inner edge 66 and outer edge 68 of rim 40. In an alternative embodiment, engagement surface 48 includes, one, three or more ribs 50, louvers 52, stops 62, and cantilever beams 64.

A second end 78 of housing 16 includes connectors 80 for attachment to lamp base 12 (shown in FIG. 1). Lamp base 12 includes a light bulb socket (not shown) and appropriate electrical connections to energize light bulb 14 (shown in FIG. 1) when lamp base 12 is connected to a power source (not shown).

Figure 5:
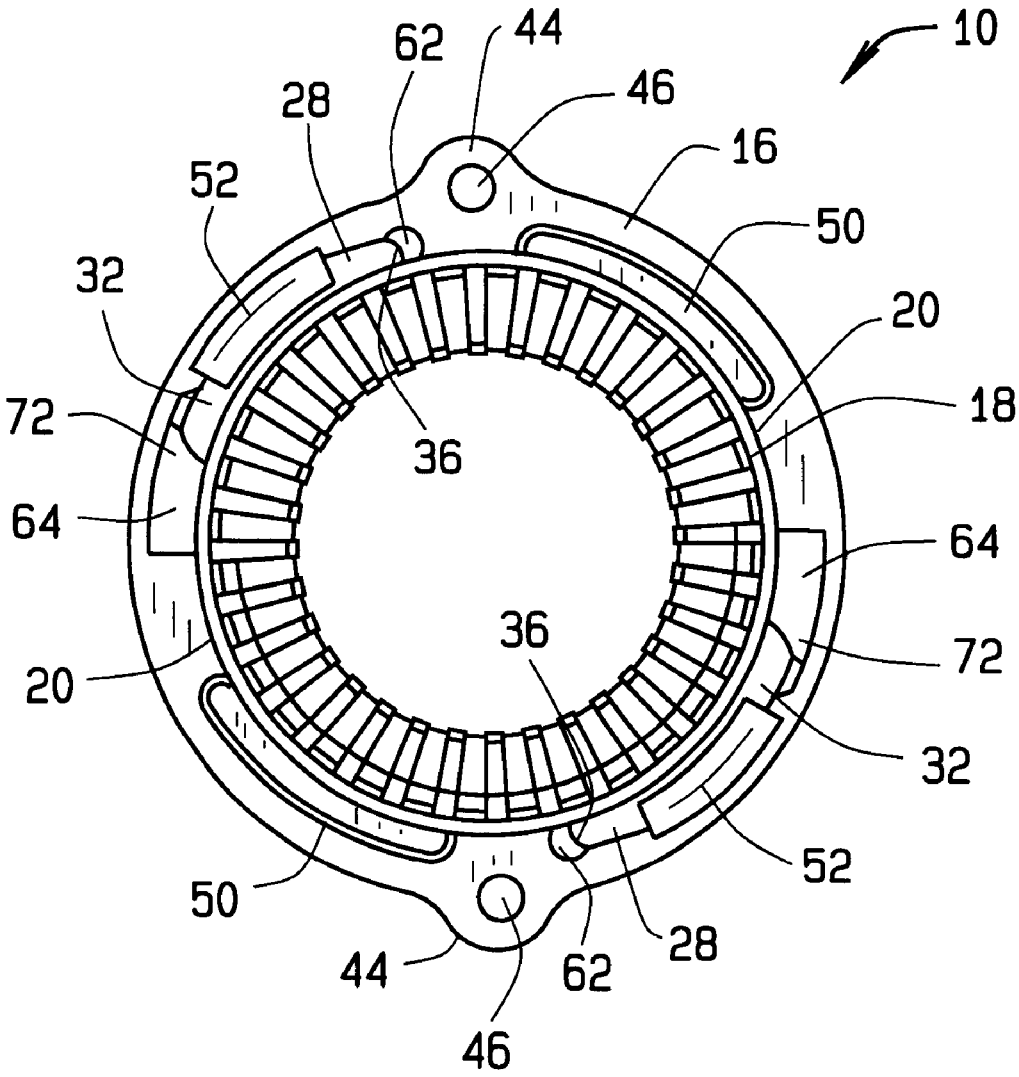
FIG. 5 is an end plan view of the oven light assembly shown in FIG. 1.

FIG. 5 is an end plan view of light assembly 10 illustrating lens 18 connected to housing 16. When lens 18 and housing 16 are connected, louvers 52 retain flanged lips 28 of lens 18 and maintain lens in contact with housing 16. Raised ribs 50 contact outer edge 20 of lens 18 and center lens 18 with respect to housing 16. Flanged lips 28 are positioned adjacent distal ends 72 of cantilever beams 64, which apply an upward force to second surfaces 34 of flanged lips 28 and maintain first surfaces 32 of flanged lips 28 in contact with louvers 52. Friction prevents lens 18 from rotating and moving flanged lips 28 out of contact with louvers 52. Stops 62 contact flanged lips 28 when lens 18 is properly positioned relative to housing 16. Cantilever beams 64 therefore maintain lens 18 properly positioned against stops 62 during shipping, handling, and subsequent use of the oven (not shown).

A method for assembling oven light assembly 10 includes connecting lamp base 12 to housing 16 and connecting housing 16 to an oven wall via openings 46 in flanges 44. Light bulb 14 is then inserted into the light bulb socket in lamp base 12. Lens 18 is positioned so that outer edge 20 of lens 18 contacts raised ribs 50 and flanged lips 28 of lens 18 are free of louvers 52 and stops 62. Lens 18 is rotated about center axis 38 until flanged lips 28 are positioned within louvers 52. Cantilever beams 64 slightly depress as lens 18 is rotated and engage flanged lips 28 with louvers 52. Lens 18 is then rotated until flanged lips 28 rest over distal ends 72 of cantilever beams 64 and side edges 36 of flanged lips 28 contact stops 62. In this position, lens 18 is properly oriented relative to housing 16 and cantilever beams 64 apply an upward force against flanged lips 28 to prevent disengagement of flanged lips 28 from louvers 52.

Lens 18 may be installed and uninstalled simply by pushing lens 18 toward housing 16, depressing cantilever beams 64 and rotating lens 18 about center axis 38 until flanged lips 28 are engaged or disengaged, respectively, from louvers 52. Thus, no tools are required to remove lens 18 from housing 16, and light bulb 14 may be replaced quickly and easily.

While the invention has been described in terms of various specific embodiments, those skilled in the art will recognize that the invention can be practiced with modification within the spirit and scope of the claims.

What is claimed is:

1. An oven light assembly, comprising:

a housing comprising at least one louver;

a lens connected to said housing, said lens comprising an outer edge, at least a portion of said outer edge positioned within said louver; and at least one cantilever beam positioned between said housing and said lens, said beam comprising a proximal end and a distal end, said proximal end connected to one of said housing and said lens, said distal end inclined toward, and in contact with, the other of said housing and said lens.

2. An oven light assembly in accordance with claim 1 wherein said outer edge comprises at least one flanged lip.

3. An oven light assembly in accordance with claim 1 wherein said lip is separated from said at least one cantilever beam.

4. An oven light assembly in accordance with claim 3 wherein said housing further comprises at least one raised rib.

5. An oven light assembly in accordance with claim 4 wherein said at least one raised rib is separated from said at least one cantilever beam.

6. An oven light assembly in accordance with claim 1 wherein said lens is serrated.

7. An oven light assembly in accordance with claim 1 wherein said housing comprises drawn sheet metal.

8. An oven light assembly in accordance with claim 1 wherein said outer edge is substantially circular.

9. An oven light assembly comprising:

a lamp base;

a housing connected to said base, said housing comprising a rim including an engagement surface, a raised rib, a louver, and an inclined cantilever beam extending from said engagement surface; and a lens connected to said housing, said lens comprising an outer edge and a flanged lip connected to said outer edge, said flanged lip comprising a first surface and a second surface, said first surface contacting said louver and said second surface contacting said cantilever beam when said lens is connected to said housing.

10. An oven light assembly in accordance with claim 9 further comprising a light bulb connected to said lamp base, said light bulb surrounded by said housing and said lens.

11. An oven light assembly in accordance with claim 9 wherein said engagement surface includes a stop, said stop contacting said flanged lip when said lens is connected to said housing.

12. An oven light assembly in accordance with claim 9 wherein said rib contacts said outer edge when said lens is connected to said housing.

13. An oven light assembly in accordance with claim 9 wherein said cantilever beam is separated from said louver.

14. An oven light assembly in accordance with claim 9 wherein said cantilever beam is separated from said rib.

15. An oven light assembly in accordance with claim 9 wherein said rim is substantially circular.

16. An oven light assembly in accordance with claim 9 wherein said housing comprises drawn sheet metal.

17. A method for assembling an oven light assembly, the assembly including a lens, a housing, a lamp base, and a light bulb, the lens including an outer edge, a center axis, and at least one flanged lip connected to the outer edge, the housing including a rim having an inclined cantilever beam extending therefrom, a plurality of raised ribs, at least one louver, and a stop, the lamp base including a light bulb socket, the housing and the lamp base mounted to an oven wall, said method comprising the steps of:

inserting the light bulb into the light bulb socket;

positioning the outer edge of the lens between the raised ribs and centering the lens with respect to the housing; and rotating the lens about the center axis until the at least one flanged lip is positioned within the at least one louver, thereby attaching the lens to the housing.

18. A method in accordance with claim 17 further comprising the step of depressing the at least one inclined cantilever beam.

19. A method in accordance with claim 18 wherein the step of rotating the lens about the center axis further comprises steps of:

positioning the at least one flanged lip adjacent the inclined end of the cantilever beam; and utilizing the cantilever beam to press the flanged lip against the louver.

20. A method in accordance with claim 19 wherein the step of rotating the lens about the center axis further comprises the step of rotating the lens about the center axis until the at least one flanged lip contacts the stop to properly orient the lens with respect to the housing.

* * * * *